United States Patent [19]

Wataya et al.

[11] Patent Number: 4,765,299

[45] Date of Patent: Aug. 23, 1988

[54] FAILURE-TIME CONTROL DEVICE FOR A FUEL INJECTION CONTROLLER OF AN INTERNAL COMBUSTION ENGINE

[75] Inventors: Seiji Wataya; Yuji Kishimoto, both of Himeji, Japan

[73] Assignee: Mitsubishi Denki Kabushiki Kaisha, Tokyo, Japan

[21] Appl. No.: 44,743

[22] Filed: May 1, 1987

[30] Foreign Application Priority Data

May 7, 1986 [JP] Japan ..... 61-106059

[51] Int. Cl.[4] ..... F02D 41/22

[52] U.S. Cl. ..... 123/479; 123/339

[58] Field of Search ..... 123/479, 494, 339, 585

[56] References Cited

U.S. PATENT DOCUMENTS 4,275,694 6/1981 Nagaishi ..... 123/494
4,450,815 5/1984 Mouri ..... 123/494
4,580,220 4/1986 Braun et al. ..... 123/479

FOREIGN PATENT DOCUMENTS 55-148925 11/1980 Japan .
58-57623 12/1983 Japan .
59-231148 12/1984 Japan ..... 123/494
2013837 2/1983 United Kingdom ..... 123/479

*Primary Examiner*—Andrew M. Dolinar
*Attorney, Agent, or Firm*—Oblon, Fisher, Spivak, McClelland & Maier

[57] ABSTRACT

A failure-time control device for a fuel injection controller of an internal combustion engine provided with a failure-time by-pass throttle valve control device to maintain a by-pass throttle valve at a definite aperture on the basis of an output signal from a trouble detecting device for detecting trouble occurred in an intake air flow detecting device; and a failure-time fuel injection valve control device which calculates a fuel quantity on the basis of a relationship of a fuel injection quantity with respect to an aperture of a main throttle valve to be determined by a definite aperture maintained by said by-pass throttle valve and the number of revolution of the engine, based on an output signal from said trouble detecting means, and which feeds by injection the fuel into the internal combustion engine by controlling the fuel injection valve on the basis of the quantity as calculated.

4 Claims, 6 Drawing Sheets

FIGURE 5
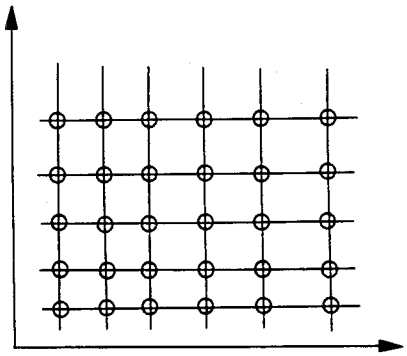
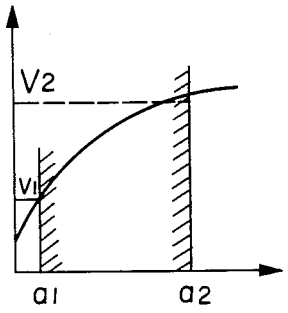
FIGURE 3
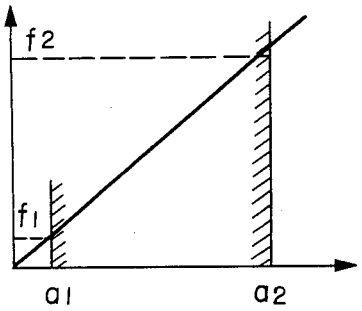
FIGURE 6

FAILURE-TIME CONTROL DEVICE FOR A FUEL INJECTION CONTROLLER OF AN INTERNAL COMBUSTION ENGINE

BACKGROUND OF THE INVENTION

1. Field of the Invention

This invention relates to a fuel injection control device of an internal combustion engine to be used for automotive vehicles, etc. More particularly, it is concerned with a faillure-time control device for such fuel injection control device of the internal combustion engine, which is capable of performing the continuous operation of the engine, even when a sensor for detecting a quantity of intake air flow is out of order.

2. Discussion of Background

FIG. 7 of the accompanying drawing illustrates a conventional fuel injection control device of the internal combustion engine of the above-described type as disclosed, for example, in Unexamined Japanese Patent Publication No. 57623/1983. In the drawing, a reference numeral 1 designates an air inlet port; a numeral 2 refers to an air cleaner for cleaning the intake air as introduced from the air inlet port 1; a numeral 3 refers to an air flow-meter for measuring a quantity of the intake air which has passed through this air cleaner 2; a reference numeral 4 denotes a throttle chamber which forms a passageway for the intake air which has passed through the air flow-meter 3; a reference numeral 5 indicates a throttle valve provided in this throttle chamber 4 and for adjusting the intake air flow which passes through the throttle chamber; a numeral 6 refers to a by-pass passage which forms a deflecting passage between the up-stream part and the down-stream part of this throttle valve 5; a reference numeral 7 designates a flow control valve which is provided on the half-way in this by-pass passage 6 and adjusts the quantity of air flowing in and through the by-pass passage 6; a reference numeral 8 represents a by-pass port which forms a deflecting passage between the up-stream part and the down-stream part of the throttle valve 5 in the same manner as in the by-pass passage 6; a numeral 9 refers to an idle adjust screw for controlling the quantity of the intake air flowing in this by-pass port 8; a numeral 10 refers to an intake manifold which is formed integrally with the above-mentioned throttle chamber 4 and constitutes a passageway for the intake air which has passed through the throttle valve 5; a reference numeral 11 indicates a fuel injector provided at the terminal part of this intake manifold 10 and for jetting out the fuel into an internal combustion engine; and a reference numeral 12 designates the internal combustion engine to burn an air-fuel mixture introduced into it, which is composed of the intake air from the intake manifold 10 and the fuel supplied from the fuel injector 11. The internal combustion engine is constructed with a cylinder **12*b*, a piston 12*a* and a combustion chamber 12*c* defined by the cylinder and the piston. A reference numeral 13 designates a variable resistor for detecting an aperture (or a degree of opening) of the throttle valve 5; a numeral 14 refers to a water temperature sensor for detecting temperature of cooling water for the internal combustion engine; 15 refers to an engine speed sensor for detecting the number of revolutions of the internal combustion engine 12; a reference numeral 16 denotes a neutral switch for detecting a power transmission 17 to be at its neutral position; a numeral 18 refers to a vehicle speed switch for detecting speed of the vehicle to be at a predetermined value (for example, 10 km/h) or lower; a reference numeral 19 denotes a micro-computer which carries out the arithmetic operations on the basis of input signals from the variable resistor 13 and water temperature sensor 14 through respective A/D converters 20 and 21 as well as input signals from the neutral switch 16 and the vehicle speed switch 18, to thereby produce an output to the flow control valve 7 through a D/A converter 22 and an output to the above-mentioned fuel injector 11. This micro-computer is constructed with an interface 19*a* for the input/output signals, a memory 19*b* storing therein command programs, and a microprocessor 19*c*** to perform various arithmetic operations in accordance with these command programs.

In the following, explanations will be given as to the basic operations of the conventional fuel injection control device of the internal combustion engine as constructed in the above-mentioned manner. First of all, the intake air as introduced from the air inlet port 1 passes through the air cleaner 2 and the throttle chamber 4 to reach the intake manifold 10. On the other hand, the intake air is detected its quantity at the air flow-meter 3, the detected signal of which is processed in the micro-computer 19 to find out a fuel flow quantity commensurate with the intake air flow. On the basis of this fuel flow as calculated, the fuel injector 11 is driven and the fuel is thus jetted out for supply into the combustion chamber **12*c*** in mixture with the intake air, where the fuel-air mixture is burned.

In the next place, explanations will be made as to the operations of the conventional fuel injection control device during idle running of the engine. First of all, the variable resistor 13 detects the approximately full closure state of the throttle valve 5, while the neutral switch 16 detects the neutral position occupied by the power transmission 17. Further, the vehicle speed switch 18 detects that the vehicle is at its speed lower than a predetermined value. These detection signals are all inputted into the micro-computer 19, and, as soon as all of the detection signals are obtained, the idling control is effected by the micro-computer 19. In more detail, the flow control valve 7 is actuated in such a manner that the number of revolution of the internal combustion engine 12 as detected by the engine speed sensor 15 may become equal to a set idling speed of the engine (e.g., 700 rpm) which has been stored in the memory **19*b* in advance, whereby the fuel injection control device is so operated as to adjust the air flowing in and through the by-pass passageway 6**, and suppress waste in the fuel consumption at the time of the idle running of the engine.

The conventional fuel injection control device of the internal combustion engine attempts to improve operativeness of the engine as well as composition of the exhaust gas during the idle running by controlling the flow control valve 7 provided in the by-pass passageway 6 which circumvents the throttle valve 5. This conventional device, however, does not give any consideration whatsoever as to the point of enabling it to operate continuously even in the case of the air flow-meter 3 getting out of order.

On the other hand, the operation and the control of the fuel injection control device, when the sensor for detecting the intake air flow is out of order, have been known from, for example, Unexamined Japanese Patent Publication No. 148925/1980, the construction of which is as shown in FIG. 8.

In FIG. 8, a reference numeral 3 designates an intake air flow measuring device of a hot-wire type, for example, which measures the quantity of air flowing in and through the air intake passage; a numeral 23 refers to a mal-function detecting device which detects an abnormal operation in the intake air flow measuring device 3; a numeral 24 refers to a trouble indicator which indicates the disorder occurred in the intake air flow measuring device 3 on the basis of an output from this mal-function detector; a reference numeral 25 represents an engine operating condition detector which detects the operating conditions of the engine such as, for example, a throttle valve aperture detector (not shown in the drawing), an engine speed detector (not shown in the drawing), and so forth; a reference numeral 26 represents an intake air flow estimating circuit which estimates the quantity of the intake air based on the throttle valve aperture signal, the engine speed signal, and so forth from the engine operating condition detector 25, without directly measuring the intake air flow by the intake air flow measuring device 3; and a numeral 27 refers to a signal selector which functions to change over a signal $Q_0$ which is directly forwarded from the intake air flow measuring device 3 and a signal $Q_1$ which is forwarded from the intake air flow estimating circuit 26 by means of a judging signal a sent from the mal-function detecting device 23, this signal selector constituting an intake air flow estimating device 28 together with the intake air flow estimating circuit 26. A reference numeral 29 designates a mixing ratio control device for determining a mixing ratio of air and fuel by taking into consideration of the signal forwarded from the signal selector 27 together with an operating condition parameter C; and numeral 30 refers to a fuel feeding device which controls the fuel injection quantity based on an output from this mixing ratio controlling device 29, a control unit 31 being constructed with the mixing ratio control device 29.

In the following, explanations will be made as to the operations of the conventional fuel injection control device of the internal combustion engine as constructed in the above-mentioned manner. First of all, in the case of the intake air flow measuring device 3 operating regularly, the signal $Q_0$ which corresponds to the air flow quantity as measured and which is forwarded from the intake air flow measuring device 3 is selected by the signal selector 27, and then is inputted into the mixing ratio control device 29. The mixing ratio control device 29 determines the mixing ratio by taking into consideration of the parameters for the operating conditions based on this signal $Q_0$. On the basis of this mixing ratio, the fuel feeding device 30 controls the fuel injection quantity to thereby maintain a favorable state of combustion.

On the other hand, in the case of the intake air measuring device 3 being out of order, the mal-function detecting device 23 detects such abnormal operation, that is, disorder in the intake air flow measuring device 3, and outputs the judging signal a, which is imparted to the signal selector 27, on account of which the mixing ratio control device 29 takes into it the signal $Q_1$ which corresponds to the estimated air flow quantity and which is forwarded from the intake air flow estimating circuit 26. Accordingly, the mixing ratio control device 29 determines the mixing ratio by taking into consideration of the parameters for the operating conditions on the basis of the above signal $Q_1$. The operations thereafter are the same as those when the device is operating regularly.

Accordingly, the device as shown in FIG. 8 is able to continuously operate the internal combustion engine, even when the intake air flow measuring device 3 should become out of order, by actuation of the fuel feeding device 30 based on the estimated quantity of the air flow to be obtained from the detection signal of the engine operating condition detecting device 25.

On the other hand, however, no consideration whatsoever has been taken in this device shown in FIG. 8 as to the point of its improvement in the operativeness of the engine and the composition of the exhaust gas during the idle running of the engine.

However, the device as shown in FIG. 7 has a problem such that it can no longer continue the engine operation, when the air flow-meter 3 for detecting the intake air flow gets out of order, while the device as shown in FIG. 8 has its own point of problem such that improvement in the operativeness of the engine and the composition of the exhaust gas during the engine idling cannot be realized.

Both of these devices, though they are identical in the general concept of the fuel injection control device of the internal combustion engine, are completely different in their actual construction, hence it is difficult to consider these two devices taken together. Even if the failure-time control device as shown in FIG. 7, wherein the fuel injection is controlled by the intake air flow estimated on the basis of the throttle valve aperture signal and the engine speed signal, is applied to the fuel injection device as shown in FIG. 8, since the device of FIG. 7 is in such a construction that it once separates the intake air which has been introduced into it through the air inlet port 1 into the one passing through the throttle valve 5 and the other passing in and through the by-pass port 8 and the by-pass passage 6, and yet, in this by-pass passage 6, since the aperture (degree of opening) of the flow control valve 7 is adjusted to vary the quantity of the intake air flowing in and through it, the relationship between the aperture of the throttle valve 5 and the quantity of the air flowing in and through the intake manifold 10 cannot be determined primarily, even if the number of revolution of the engine is constant. In addition, the throttle valve 5 during the idle running of the engine is approximately in its full open state. As the consequence of this, with the device of FIG. 8, estimation of the intake air flow becomes difficult from the throttle valve aperture signal, hence it is not possible to find out the fuel quantity commensurate with the intake air flow, and, when a satisfactory combustion is controlled by the intake air flow as estimated on the basis of the engine speed (number of revolution), there takes place in some cases a large difference between the estimated air flow quantity and the actual air flow quantity; in particular, during the idle running of the engine, it is no longer possible to find the fuel quantity proportionate to the actual intake air flow, which results in raising such a problem that no favorable engine combustion can be effected.

SUMMARY OF THE INVENTION

The present invention has been made with a view to removing various points of problem with the conventional fuel injection control device as described in the foregoing, and aims at providing, with a view to attaining improvement in the operativeness of the engine and the composition of the exhaust gas during the idle running of the engine, a failure-time control device for the fuel injection controller of the internal combustion engine capable of effecting satisfactory combustion of the engine, even when the air flow-meter of the internal combustion engine provided in the by-pass passage gets out of order.

According to the present invention, in general aspect of it, there is provided a failure-time control device for a fuel injection controller of the internal combustion engine, which comprises in combination; (a) a trouble detecting means for detecting trouble in an intake air flow detecting means which detects a quantity of intake air flow to be introduced into an air intake passage communicatively connected with the internal combustion engine; (b) a failure-time by-pass throttle valve control means for maintaining, at a definite value on the basis of an output from said trouble detecting means, an aperture of a by-pass throttle valve which controls the quantity of air in an by-pass passage between the up-stream part and the down-stream part of a main throttle valve which controls said intake air flow; and (c) a failure-time fuel injection valve control means for controlling a fuel injection quantity from a fuel injection valve for supplying fuel to said internal combustion engine by injection, on the basis of a relationship of the fuel injection quantity with respect to an aperture of said main throttle valve to be determined by an aperture of said by-pass throttle valve held in said failure-time by-pass throttle valve control means and the number of revolution of said internal combustion engine.

In the failure-time control device of the present invention, when the intake air flow detecting device gets out of order, the failure-time by-pass throttle valve control device maintains constant the aperture of the by-pass throttle valve, and, at the same time, the failure-time fuel injection valve control device feeds by injection into the internal combustion engine through the fuel injection valve a quantity of fuel which has been found on the basis of the main throttle valve aperture to be determined by the constant aperture of the by-pass throttle valve and the engine speed as well.

The foregoing object, other objects as well as specific construction and operations of the failure-time fuel injection control device according to the present invention will become more apparent and understandable from the following detailed description of a preferred embodiment thereof, when read in conjunction with the accompanying drawing.

BRIEF DESCRIPTION OF THE ACCOMPANYING DRAWING

In the drawing:

FIG. 1 is a schematic block diagram showing a general concept of the failure-time fuel injection control device according to the present invention;

FIGS. 2 to 5 illustrate a preferred embodiment of the present invention, in which FIG. 2 is an overall structural diagram; FIG. 3 is a graphical representation showing a characteristic curve of a hot-wire type intake air flow detecting device 3; FIG. 4 is a flow chart showing the operations of the microcomputer 36; and FIG. 5 is a data-map for finding a basic pulse of the fuel injection from both aperture of the by-pass throttle valve and the engine speed;

FIG. 6 is a graphical representation showing a characteristic curve of Karman's vortex street type intake air flow detecting device 3;

DETAILED DESCRIPTION OF THE PREFERRED EMBODIMENT

Figure 1:
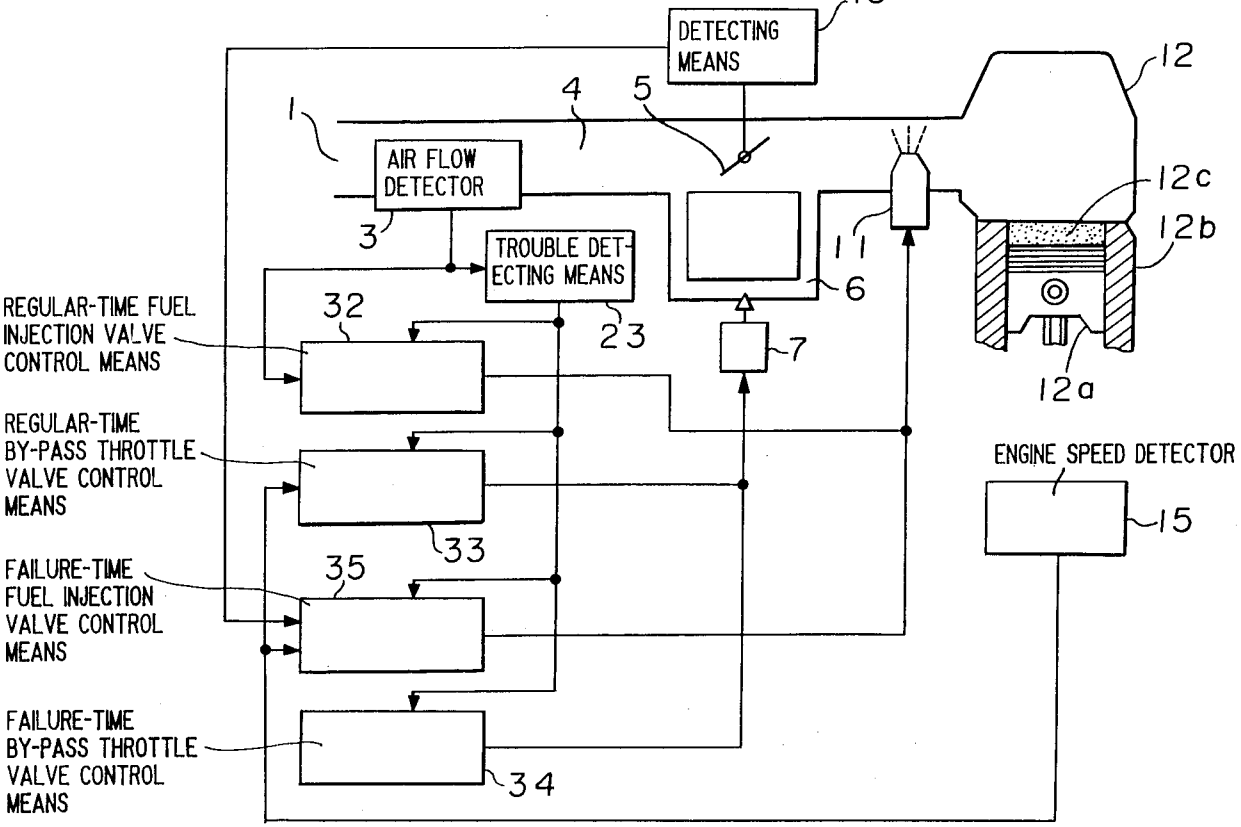
Figure 2:
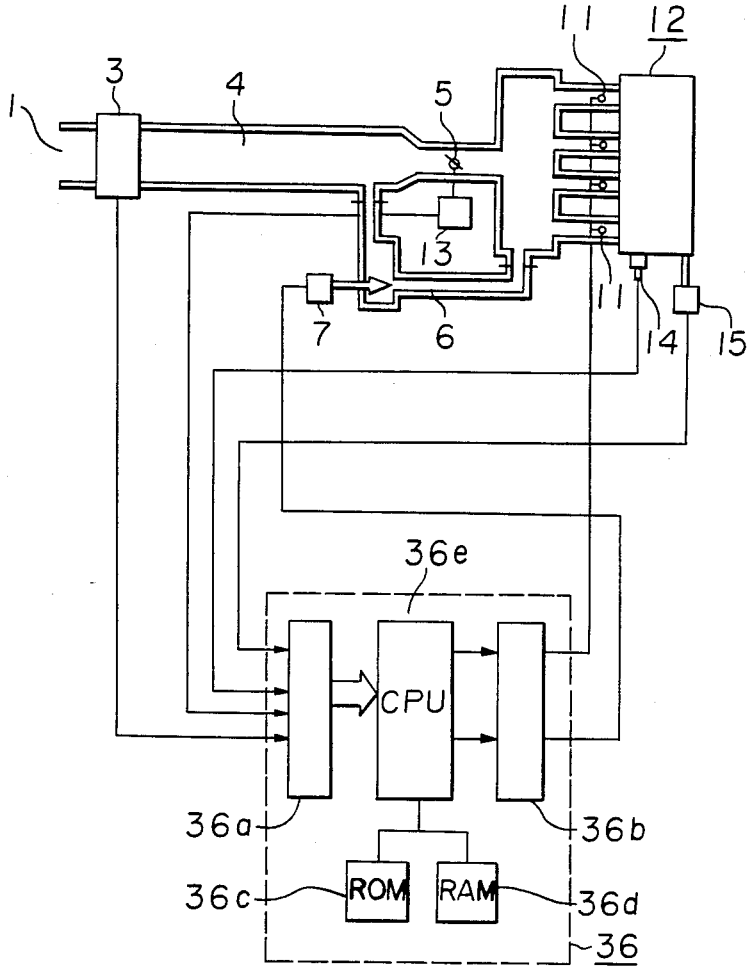

In the following, the present invention will be described in detail with reference to a preferred embodiment as shown in the accompanying drawing. Referring first to FIG. 1 showing the general concept of the fuel injection control device according to the present invention, a reference numeral 4 designates an air intake passage constituting a path, through which the intake air as introduced from the air inlet port 1 flows into the combustion chamber 12*c*; a numeral 3 refers to the intake air flow detecting device for detecting the quantity of air flowing in and through the air intake passage 4; a reference numeral 5 represents the main throttle valve for adjusting the quantity of air flowing in and through the air intake passage 4, the valve being associated with an accelerator pedal (not shown in the drawing); a reference numeral 6 denotes a by-pass passage between the up-stream part and the down-stream part of the main throttle valve 5; a numeral 7 refers to the by-pass throttle valve for adjusting the quantity of air flowing in and through this by-pass passage 6; a reference numeral 11 designates the fuel injection valve provided at the terminal part of the air intake passage 4 and for feeding by injection to the fuel into the air, the fuel as injected being mixed with the air and fed into the combustion chamber 12*c*; a reference numeral 23 denotes the trouble detecting means for detecting disorder in the intake air flow detecting means 3 upon its receipt of an output from the intake air flow detecting means 3; a numeral 13 refers to the main throttle valve aperture detecting means for detecting a degree of opening of the main throttle valve 5; a reference numeral 15 indicates the engine speed detecting means for detecting the number of revolution of the internal combustion engine 12 (hereinafter referred to as "engine speed"); a numeral 32 refers to a regular-time fuel injection valve control means which receives thereinto an output from the trouble detecting means 23 and an output from the intake air flow detecting means 3 to control the fuel injection quantity from the fuel injection valve 11 on the basis of the output from the intake air flow detecting means 3, when it is operating regularly; and a numeral 33 refers to a regular-time by-pass throttle valve control means which receives thereinto an output from the trouble detecting means 23 and an output from the engine speed detecting means 15 to drive the by-pass throttle valve 7 and to adjust its aperture, when the intake air flow detecting means 3 is operating regularly, the control means adjusting, for example, the aperture of the intake air flow detecting means 3 so that the engine speed may reach a pre-established idling speed, when the internal combustion engine 12 is in an idle running condition. A reference numeral 34 designates a failure-time by-pass throttle valve control means which receives thereinto an output from the trouble detecting means 23, and maintains the aperture of the by-pass throttle valve 7 at a certain definite value when the intake air flow detecting means 3 gets out of order; and a numeral 35 refers to a failure-time fuel injection valve control means which receives thereinto outputs from each of the trouble detecting means 23, the main throttle valve aperture detecting means 13 and the engine speed detecting means 15 to control, when the intake air flow detecting means 3 gets out of order, the fuel injection quantity from the fuel injection valve 11 on the basis of a relationship of the fuel injecting quantity with respect to the aperture of the main throttle valve 5 to be determined by the aperture of the by-pass throttle valve 7 held by the failure-time by-pass throttle valve control means 34 and the engine speed (number of its revolution).

In the fuel injection control device of the internal combustion engine as constructed in the foregoing manner, if the intake air flow detecting means 3 is in the regular operation, the trouble detecting means 23 selects the regular-time fuel injection valve control means 32 and the regular-time by-pass throttle valve control means 33 to thereby control the fuel injection valve 11 and the by-pass throttle valve 7 respectively; on the other hand, if the intake air flow detecting means 3 is out of order, the trouble detecting means 23 selects the failure-time fuel injection valve control means 35 and the failure-time by-pass throttle valve control means 34 to thereby control the fuel injection valve 11 and the by-pass throttle valve 7 respectively. In this way, even when the intake air flow detecting means 3 gets out of order, it is still possible to continue operation of the internal combustion engine 12, while maintaining a satisfactory combustion state.

In the following, the present ivention will be explained with reference to one preferred embodiment thereof as shown in FIGS. 2 to 5. In the drawing, a reference numeral 3 designates the intake air flow detecting device of a well known "hot-wire" type, which has the output voltage characteristic with respect to the intake air flow as indicated by a curve in FIG. 3; a reference numeral 7 represents the by-pass throttle valve of a well known "stepping motor" type, which is able to set its degree of opening (aperture) in correspondence to a given pulse number; a numeral 14 refers to the water temperature detecting means for detecting a temperature of the cooling water; a reference numeral 36 denotes the micro-computer which receives thereinto each of the outputs from the intake air flow detecting means 3, the main throttle valve aperture detecting means 13, the engine speed detecting means 15, and the water temperature detecting means 14, and which processes each of these signals to impart a drive signal to the fuel injection valve 11 and the by-pass throttle valve 7. The micro-computer has an input interface **36*a* and an output interface 36*b* for processing respectively input and output signals, a read-only-memory (ROM) 36*c* which stores therein command programs and others, a random-access-memory (RAM) 36*d* which temporarily stores therein various data, and a central processing unit (CPU) 36*e* for carrying out the arithmetic operations in accordance with the command programs, these constituent elements carrying out the respective functions of the trouble detecting means 23, the regular-time fuel injection valve control means 32, the regular-time by-pass throttle valve control means 33, the failure-time fuel injection valve control means 35, and the failure-time by-pass throttle valve control means 34**.

Figure 4:
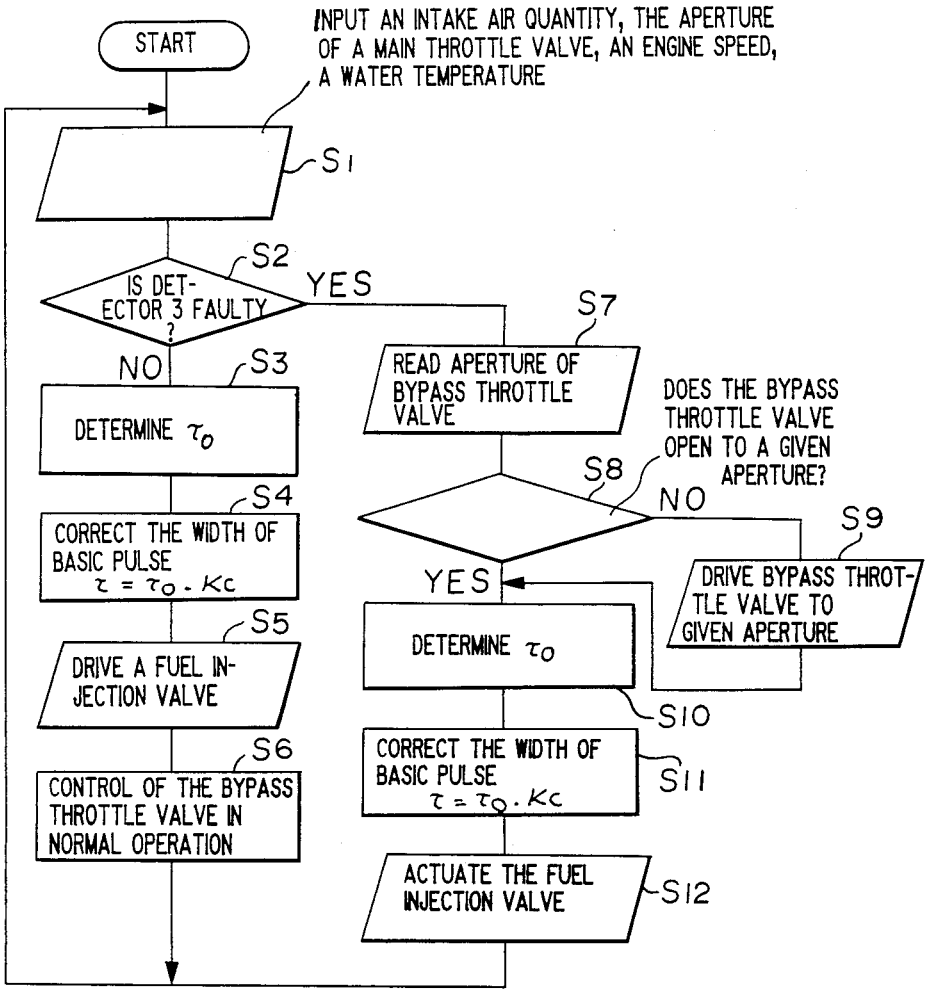
Figure 7:
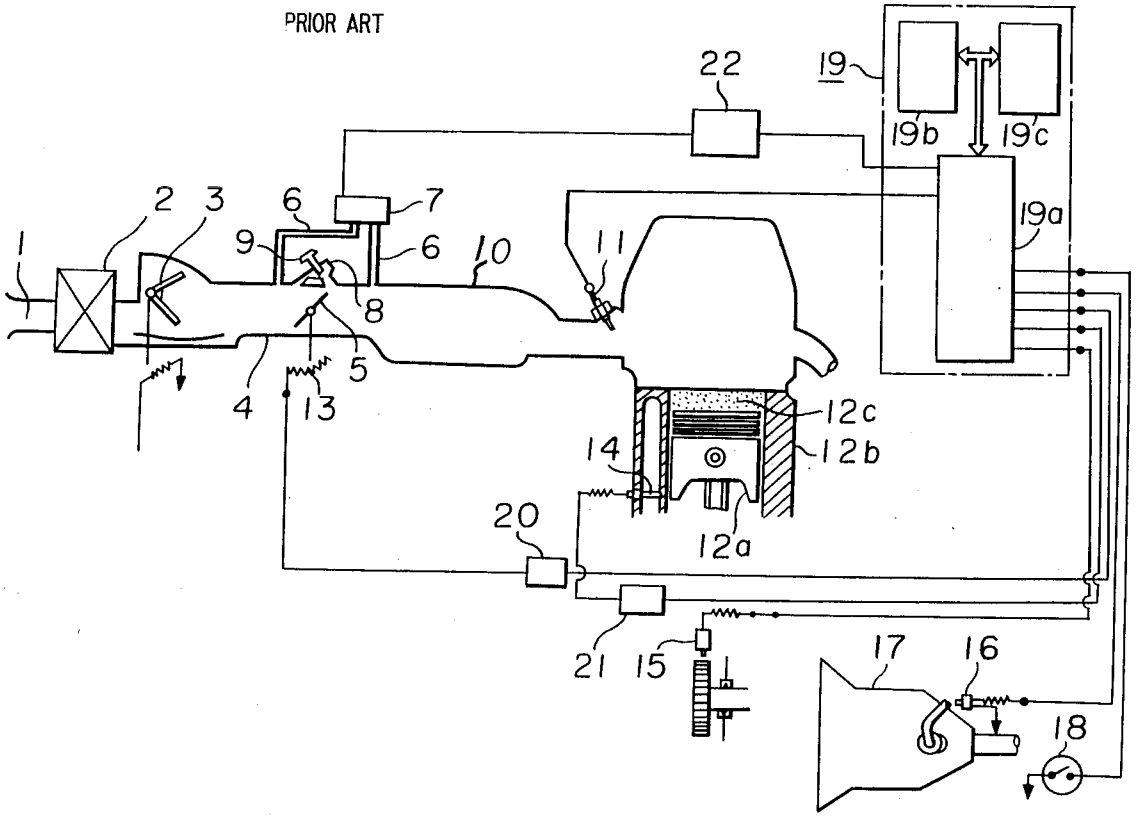
FIGURE 7 PRIOR ART
FIG. 7 is a schematic overall structural diagram showing the conventional fuel injection control device of the internal combustion engine.
Figure 8:
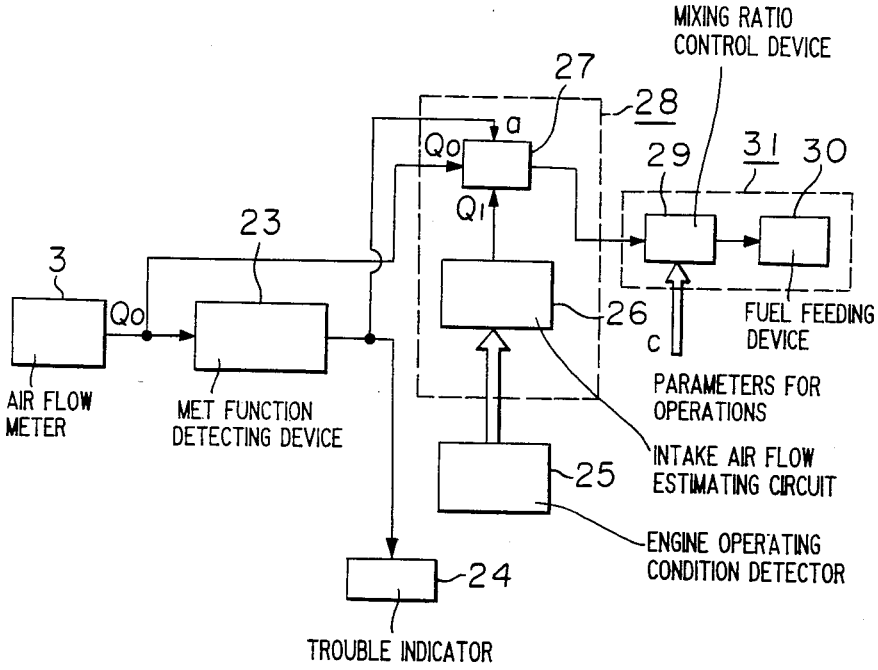
FIGURE 8 PRIOR ART
FIG. 8 is a schematic block diagram showing an overall structure of the failure-time fuel injection control device for the conventional fuel injection control device of the internal combustion engine.

In the following, explanations will be given as to the operations of the failure-time control device according to the preferred embodiment of the present invention. First of all, when the power source is closed, the micro-computer 36 commences its operation to perform the processing in accordance with its flow chart as shown in FIG. 4. On the other hand, the intake air flow detecting means 3 detects the quantity of the intake air flow to be introduced into the air inlet passage 4; the main throttle valve aperture detecting means 13 detects the aperture of the main throttle valve 5; the engine speed detecting means 15 detects the number of revolution of the internal combustion engine 12; and the water temperature detecting means 14 detects temperature of the cooling water circulating in the internal combustion engine 12. The output signals from these detecting means are imparted to the micro-computer 36 which carries out the arithmetic operations on the basis of these signals and produces an output control signal. This control signal is imparted to the fuel injection valve 11 and the by-pass throttle valve 7, whereby the fuel injection quantity and the aperture of the by-pass throttle valve 7 are controlled.

When the intake air flow detecting means 3 is in its regular operation, the fuel injection quantity commensurate with the intake air flow is found by the arithmetic operations of the micro-computer 36 based on the output from the intake air flow detecting means 3, and a determined quantity of the fuel is injected from the fuel injection valve 11. On the other hand, when the intake air flow detecting means 3 gets out of order, the micro-computer 36 judges the trouble occurred in this detecting means from its output signal, on the basis of which it fixes the aperture of the by-pass throttle valve 7 at a definite value, and thereafter it estimates the quantity of the intake air flow from the output signal from the main throttle valve aperture detecting means 13 and the output signal from the engine speed detecting means 15, and then supplies by injection a determined quantity of the fuel from the fuel injection valve 11, as found from the arithmetic operations on the basis of the estimation.

In the following, further detailed explanations will be made in reference to FIG. 4 illustrating the operations of the micro-computer 36. At first, each of the output signals from the intake air flow detecting means 46, the main throttle valve aperture detecting means 13, the engine speed detecting means 52 and the water temperature detecting means 14 are inputted into the micro-computer 36 through its input interface **36*a*, as in the step S1. Subsequently, as in the step S2, judgement is made as to whether the intake air flow detecting means 3 operates regularly, or not, on the basis of an output signal from the intake air flow quantity detecting means 3 as inputted as the step S1. In more detail, as already mentioned in the foregoing, the intake air flow detecting means 3 of the hot-wire type has its output voltage characteristic with respect of the quantity of the intake air flow in the form of the curve as shown in the graphical representation of FIG. 3. Therefore, so far as it is operating regularly, its output voltage within a range of the upper limit value $V_2$ and the lower limit value $V_1$ of the output voltage values corresponding to the upper limit value $a_2$ and the lower limit value $a_1$ of the intake air flow to be actually introduced into it can be obtained as the output signal from the intake air flow detecting means 3, so that, when an output voltage value is outside this range, it is judged to be the disorder in the detecting means. In this manner, judgement is made as to whether the intake air flow detecting means is out of order, or not. In the case of its regular operation, the intake air flow detecting means operates therafter in accordance with the steps S3 to S6**; and, in the case of its disorder, the detecting means operates in accordance with the steps S7 to S12.

In the following, explanations will be made as to the operations of the intake air flow detecting means 3, when it is working regularly. First of all, as in the step S3, a basic pulse width $\tau_0$ corresponding to a time required for opening the fuel injection valve 11 is found from a data-map showing a relationship between the intake air flow, which has been stored in advance in the ROM 36c, and the basic pulse width $\tau_0$, on the basis of the intake air flow as detected. Subsequently, as in the step S4, this basic pulse width $\tau_0$ is corrected by multiplication of the correction factor Kc which has been obtained from the arithmetic operations on the basis of the water temperature, etc. as detected to thereby find out a pulse width $\tau$, after which a valve opening signal having this pulse width $\tau$ as obtained at the step S4 is imparted to the fuel injection valve 11, thereby feeding the fuel by injection into the internal combustion engine. Thereafter, as in the step S6, when the internal combustion engine 12 is in its idle running condition, the aperture of the by-pass throttle valve 7 is so adjusted that the set idling speed as stored in the ROM 36c in advance may be coincident with the engine speed as detected, thereby controlling the internal combustion engine 12 to be operated at the set idling speed. Furthermore, in case the internal combustion engine 12 is in its normal operating conditions other than its idle running condition, and yet a load imposed on the internal combustion engine during its idle running, such as an air-conditioner, etc. (not shown in the drawing), is in operation, the by-pass throttle valve is established to have its aperture (degree of opening) necessary for achieving the set idling speed during the operation of this air-conditioner, while the engine is idling, so that the internal combustion engine 12 may not stop its operation, when it abruptly shifts from the ordinary operating condition to the idling condition; on the other hand, in case the air-conditioner is in stoppage, the by-pass throttle valve is established to have its aperture necessary for achieving the set idling speed, while no load is imposed on the internal combustion engine, whereby the control of the internal combustion engine is so carried out that, even when the engine is changed from its normal operating condition over to its idling condition, there may be obtained promptly the optimum idling speed proportionate to the load condition in such situation. Thus while the intake air flow detecting means 3 is in the regular operations, the engine repeatedly carries out the operations as shown in the steps S1 to S6.

In the next place, explanations will be given as to the operations of the intake air flow detecting means 3, when it gets out of order.

After each of the detection signals has been inputted into the micro-computer as in the step S1, the disorder occurred in the intake air flow detecting means is detected as in the step S2, and then the operations in the steps S7 to S12 are carried out. That is to say, as in the step S7, the computer reads out the aperture of the by-pass throttle valve 7 immediately after its detection of the trouble in the detecting means; however, since this by-pass throttle valve 7 of the stepping motor type is capable of establishing its aperture in correspondence to the number of pulses which the micro-computer 36 produces as the output, it is possible to know the aperture of the by-pass throttle valve by reading of a predetermined address in the RAM 36d where the number of the pulses which the micro-computer was outputting before it detects the trouble in the intake air flow detecting means 3. Following this, as in the step S8, judgement is made as to whether the aperture of the by-pass throttle valve as read out in the preceding step S7 is coincident with the predetermined set aperture at the time of the disorder occurred, which has been stored in advance in the ROM 36c. When they are not coincident, a pulse number corresponding to a difference between the actual aperture and the set aperture is imparted to the by-pass throttle valve 7, thereby maintaining the aperture at the set value. This set aperture of the by-pass throttle valve is so established that a no-load idling speed of the engine at the time of the disorder in the intake air flow detecting means may be higher by 100–500 rpm than a no-load idling speed of the engine when the intake air flow detecting means is operating regularly (without trouble being occurred therein). Then, when the by-pass throttle valve is at a definite aperture from the beginning as shown in the tstep S8, or, after it has actually been established to have a definite aperture as shown in the step S9, there will be found the basic pulse width $\tau_0$ from the data-map showing a relationship of the basic pulse width $\tau_0$ with respect to both the aperture of the main throttle valve as shown in FIG. 5, which has been stored in the ROM 36c in advance in correspondence to the definite aperture, and the engine speed, on the basis of the aperture of the main throttle valve and the engine speed, as detected, as shown in the step S10; then, as shown in the steps S11 and S12 respectively corresponding to the steps S4 and S5, the basic pulse width $\tau_0$ is corrected by multiplying a correction factor Kc obtained from the arithmetic operations based on the water temperature, etc., and the fuel injection valve 11 is operated for a time period corresponding to the thus obtained pulse width $\tau$. Thereafter, the operations as in the steps S1, S2, S7, S8 and S10 to S12 are repeatedly executed.

Of the above-described steps for the sequence operations, the step S2 corresponds to the role of the trouble detecting means 23 in FIG. 1 indicating the general concept of the present invention; in the same way, the steps S3 and S5 correspond to the role of the regular-time fuel injection valve control means 32; the step S6 corresponds to the role of the regular-time by-pass throttle valve control means 33; the steps S7 to S9 correspond to the role of the failure-time by-pass throttle valve control means 34; and the steps S10 to S12 correspond to the role of the failure-time fuel injection valve control means 35.

Thus, this particular embodiment of the present invention is realized by the trouble detecting means 23, the regular-time fuel injection valve control means 32, the regular-time by-pass throttle valve control means 33, the failure-time by-pass throttle valve control means 34, the failure-time fuel injection valve control means 35, and the micro-computer 36. Whether the intake air flow detecting means 3 is operating regularly, or not is constantly, or not is constantly monitored at the step S2 which corresponds to the role of the trouble detecting means 3. Thus, the elements to be controlled are varied in accordance with the operating conditions of the intake air flow detecting means 3. In more detail, while the intake air flow detecting means 3 is operating regularly, a quantity of the fuel which is able to achieve the perfect combustion with this intake air flow is calculated on the basis of the intake air flow as detected by the intake air flow detecting means 3 as shown in the steps S3 to S5 which correspond to the role of the regular-time fuel injection valve control means 32. The weight ratio between this air quantity and the fuel quantity is generally termed "air-fuel ratio", wherein, when this ratio becomes coincident with the theoretical air-fuel ratio (14.8:1), the perfect combustion of the fuel is achieved. Namely, the fuel quantity as obtained in the above-mentioned manner is fed by injection from the fuel injection valve 11 to thereby operate the internal combustion engine 12 at an ideal air-fuel ratio. On the other hand, when the intake air flow detecting means 3 gets out of order, the quantity of the intake air flow can no longer be detected directly, on account of which the quantity of the fuel to be injected is found on the basis of an output from the main throttle valve aperture detecting means 13 and the engine speed detecting means 15, as shown in the steps S10 to S12 which correspond to the role of the failure-time fuel injection valve control means 35, to thereby operate the fuel injection valve 11. This operation is, however, nothing but the operation of the fuel injection valve 11 by first estimating the intake air flow quantity from the main throttle valve aperture and the engine speed, and then finding out the fuel quantity which is commensurate with this intake air flow. Moreover, as shown in the steps S7 to S9 which correspond to the role of the failure-time by-pass valve control means 34, since the aperture of the by-pass throttle valve 7 is maintained constant, a relationship between the aperture of the main throttle valve 5 and the intake air flow, when the engine speed is made constant, can be determined primarily. On account of this, the quantity of the intake air flow can be estimated more accurately from the relationship between the aperture of the main throttle valve 5 and the engine speed. As the consequence of this, in accordance with the arithmetic operations as shown in the step S10, the quantity of the fuel to be injected can be accurately found in commensuration with the intake air flow quantity from both aperture of the main throttle valve 5 and the engine speed, based on which the fuel is fed by injection from the fuel injection valve 11. Owing to such operations, the internal combustion engine 12 exhibits its effect of being operated at such ideal air-fuel ratio even at the time of the disorder in the intake air flow detecting means 3.

Moreover, as shown in the step S9, since the aperture of the by-pass throttle valve at the time of the trouble occurred in the intake air flow detecting means 3 is so established that no-load idling speed may be higher by 100 to 500 rpm than the no-load idling speed when no disorder takes place in the detecting means, the internal combustion engine 12 can be continuously operated without its being stopped, even when the load begins to operated during the idle running of the engine.

In addition, when no air-conditioning apparatus, power-steering device, and others to be the load during the idle running of the engine are installed, there occurs no inconvenience whatsoever, even if the no-load idling speed during the disorder in the detecting means is coincident with the no-load idling speed during the regular operation of the detecting means.

By the way, in the embodiment of the present invention, when the well known Karman's vortex street type intake air flow detecting means 3 is used, the characteristic of the detection signal is such one as shown in FIG. 6, wherein the signal has a frequency proportionate to the intake air flow. Therefore, when this Karman's vortex street type intake air flow detecting means is regularly operating, there can be obtained an output frequency within the range of the output frequency of $f_1$ and $f_2$ which correspond respectively to the upper and the lower limit values $a_1$ and $a_2$ of the intake air flow to be actually taken into the air inlet passage, as is the case with the hot-wire type intake air flow detecting means, so that any output frequency of a value outside this range may be judged as the trouble occurred in the detecting means.

Further, as the by-pass throttle valve 7, there may be employed, besides the stepping motor type throttle valve, a well known linear solenoid type throttle valve which is capable of maintaining constant the aperture of the valve with the excitation current being kept at a definite value. By the way, it is also possible to employ a feed-back control system wherein comparison is made between the set value as stored in the ROM **36*c* and the actual aperture by means of a sensor for detecting the actual aperture of the by-pass throttle valve 7**.

Furthermore, where there are irregularities in the production of the by-pass throttle valve 7, errors in assembling the by-pass throttle valve 7 in the by-pass passage 6, or change in the precision in the by-pass throttle valve due to its use over a long period of time, it would occur that no intended aperture can be achieved even if a control output is imparted to the by-pass throttle valve for it to attain a definite degree of opening. On account of this, in the control of the by-pass throttle valve 7 during its regular operation as shown in the step S6, a correction value which corresponds to the errors due to the factors is found from the control output which is required for maintaining the aperture of the by-pass throttle valve when the set idling speed is achieved, the thus obtained correction value being stored in the RAM **36*d*, and, at the time of the operation as shown in the step S9, the control output value required for maintaining the aperture of the by-pass throttle valve 7 as stored in the ROM 36*c* at its predetermined set aperture value is corrected with the correction value. In so doing, even if there takes place the error factor, the basic pulse width to be obtained at the step S10** can lead to the optimum air-fuel ratio, whereby more favorable combustion state can be attained.

As has been described in the foregoing, the present invention is so constructed that the trouble detecting means detects a trouble occurred in the intake air flow detecting means; the failure-time by-pass throttle valve control means, upon its receipt of the detection signal from the trouble detecting means, maintains the by-pass throttle valve at a certain definite aperture; at the same time, the failure-time fuel injection valve control means finds out a fuel quantity on the basis of the aperture of the main throttle valve and the engine speed; and the thus determined quantity of the fuel is fed by injection from the fuel injection valve into the combustion chamber. On account of such construction, there accuers such effect that, even with the failure-time control device which is provided with the by-pass passage and the by-pass throttle valve in an attempt to improve the operativeness of the engine and the composition of the exhaust gas during the idle running of the engine, a favorable state of combustion can be achieved.

Although, the present invention has been described in specific details with reference to a preferred embodiment thereof, it should be noted that the embodiment is illustrative only and not so restrictive, and that any changes and modifications may be made by those skilled persons in the art without departing from the spirit and scope of the invention as recited in the appended claims.

What is claimed is:

1. A failure-time control device for a fuel injection controller of a internal combustion engine, which comprises in combination:

(a) a trouble detecting means for detecting trouble in an intake air flow detecting means which detects a quantity of intake air flow to be introduced into an air intake passage communicatively connected with the internal combustion engine;

(b) a failure-time by-pass throttle valve control means for maintaining, at a definite value on the basis of an output from said trouble detecting means, an aperture of a by-pass throttle valve which controls the quantity of air in a by-pass passage between the up-stream part and the down-stream part of a main throttle valve which controls said intake air flow; and (c) a failure-time fuel injection valve control means for controlling a fuel injection quantity from a fuel injection valve for supplying fuel to said internal combustion engine by injection, on the basis of a relationship of the fuel injection quantity with respect to an aperture of said main throttle valve and the number of revolutions of said internal combustion engine with said by-pass throttle valve aperture held at said definite value.

2. The failure-time control device for a fuel injection controller of an internal combustion engine according to claim 1, wherein said failure-time by-pass throttle valve control means maintains an aperture of said by-pass throttle valve in such a manner that a no-load idling speed of the engine at the time of trouble in said intake air flow detecting means is higher than a no-load idling speed of the engine at the time of no trouble occurred in said intake air flow detecting means.

3. The failure-time control device for a fuel injection controller of an internal combustion engine according to claim 1, wherein said failure-time by-pass throttle valve control means maintains an aperture of said by-pass throttle valve in such a manner that a no-load idling speed of the engine at the time of trouble occurred in said intake air flow detecting means is higher by 100 to 500 rpm than a no-load idling speed of the engine at the time of no trouble occurred in said intake air flow detecting means.

4. The failure-time control device for a fuel injection controller of an internal combustion engine according to claim 1, wherein the aperture of said by-pass throttle valve which is controlled by said failure-time by-pass throttle valve control means is corrected on the basis of a relationship between the aperture of said by-pass throttle valve and the number of revolutions of the internal combustion engine in the idle running condition of the engine at the time of no trouble being detected in said intake air flow detecting means.

* * * * *